United States Patent [19]

Glass

[11] 4,022,435

[45] May 10, 1977

[54] MOLDED SCROLL DESIGNS FOR FENCE STRUCTURE

[76] Inventor: Carl R. Glass, Rte. 1, Box 59, P-1, Kissimmee, Fla. 32741

[22] Filed: Apr. 16, 1976

[21] Appl. No.: 677,454

[52] U.S. Cl. ..... 256/1; 52/663

[51] Int. Cl.[2] ..... E04H 17/00

[58] Field of Search ..... 256/22, 1; 52/507, 663; 85/52; D25/38, 71, 87

[56] References Cited

UNITED STATES PATENTS

| | | | |
|---|---|---|---|
| 114,584 | 5/1871 | May | 52/663 |
| 345,769 | 7/1886 | Cary | 52/663 |
| 3,745,615 | 7/1973 | Oberreich | 52/663 |

*Primary Examiner*—Werner H. Schroeder
*Assistant Examiner*—Doris L. Troutman
*Attorney, Agent, or Firm*—Sughrue, Rothwell, Mion, Zinn & Macpeak

[57] ABSTRACT

Decorative scrolls for metal fence posts are fabricated of plastic material, and have outer face plates with interior and exterior walls. Scroll members on the interior walls are spaced apart at flat sections to engage the post, and frictionally grip the same. Additional fastening means on the scroll members also engage the back side of the post.

6 Claims, 7 Drawing Figures

FIG. 1
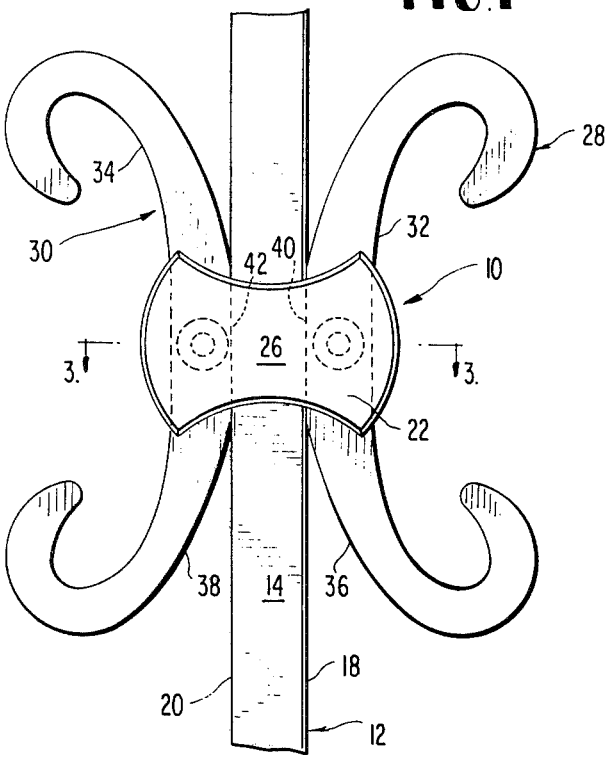
FIG. 3
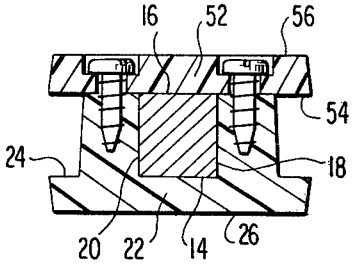
FIG. 4
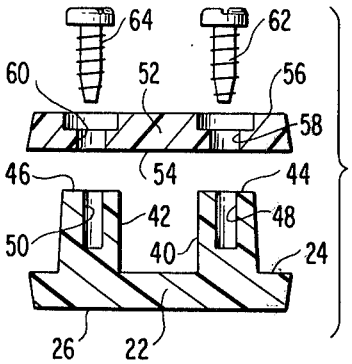
FIG. 2
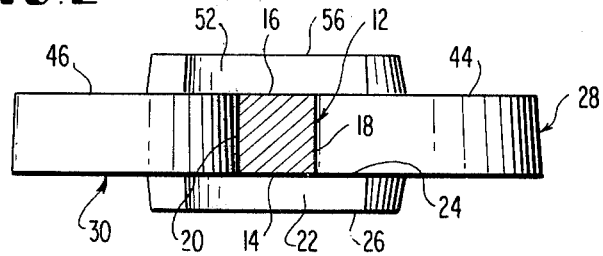
FIG. 6
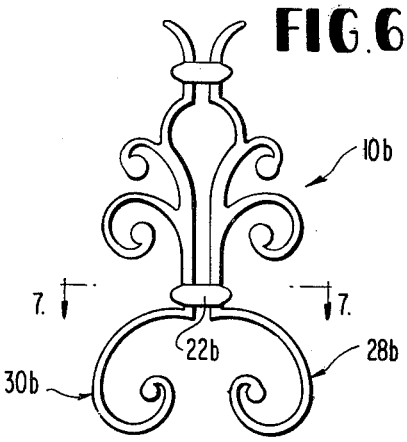
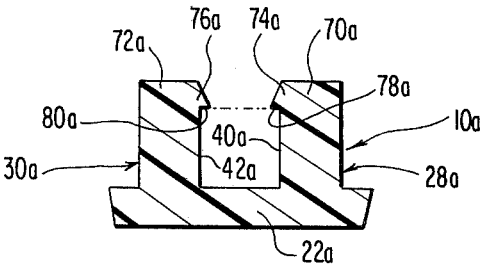
FIG. 5
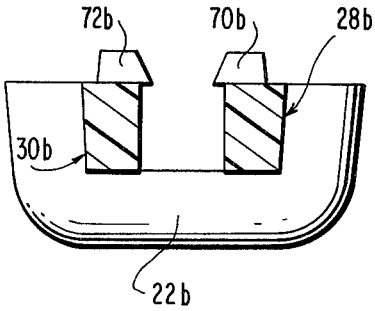
FIG. 7

MOLDED SCROLL DESIGNS FOR FENCE STRUCTURE

BACKGROUND OF THE INVENTION

1. Field of the Invention:

This invention pertains to decorative scroll work employed in enhancing the appearance of fences, railings, and the like.

2. Statement of the Prior Art

Various metallic scrolls for wrought iron fences, in various design forms, have been known and used throughout the time that such fences have been known, the prior art scrolls being traditionally formed of the same material as the fence, and attached to the posts by welding or the like.

SUMMARY OF THE INVENTION

The present invention provides decorative scrolls applicable to fences, gates, grills, rails or other structures embodying vertical posts or rails, the scrolls being fabricated from rigid plastic. The scrolls are quickly and easily applied to new or existing structures by non-complex connecting means, and do not require welding procedures to install.

The ease of attachment of the scrolls maximizes the potential for creation of design variations using the scrolls hereof, and permits subsequent changes in design appearance. This feature also reduces cost by avoiding the need for special attachment skills.

The scrolls are light in weight and non-corrosive, thus leading to reduction in cost and long life.

Other and further objects and advantages of the invention will become apparent to those skilled in the art from a consideration of the following specification when read in conjunction with the annexed drawings.

BRIEF DESCRIPTION OF THE DRAWING

FIG. 1 is a front elevational view of a portion of fence post with a scroll hereof in place thereon;

FIG. 2 is a top plan view of the unit of FIG. 1, the fence post being shown in cross-section;

FIG. 3 is a sectional view on line 3—3 of FIG. 1, looking in the direction of the arrows;

FIG. 4 shows the components of FIG. 3 in disassembled form;

FIG. 5 shows a first modified base plate;

FIG. 6 is a front elevation of a modification having a snap-on connection arrangement; and FIG. 7 is a sectional view of the arrangement shown in FIG. 6, taken on line 7—7 of FIG. 6 looking in the direction of the arrows.

DESCRIPTION OF THE PREFERRED EMBODIMENT

Referring to the drawing in more detail, and initially to FIGS. 1 through 4, the decorative scroll of this invention is therein generally identified by reference numeral 10. The scroll is adapted for application to a metallic post 12 forming a part of a fence, grill or the like. The post, for purposes of description and orientation herein, has front and back sides 14, 16 and lateral sides 18 and 20.

The scroll includes a face plate 22 having interior and exterior side surfaces 24 and 26, respectively. A pair of laterally spaced scroll members 28 and 30 are secured, either integrally or by other bonding means, on the interior side surface 24 of the face plate. The scroll members have distal surfaces 32, 34 and proximal surfaces 36, 38. At substantially mid-length positions, the proximal surfaces have substantially parallel, confronting flat sections 40 and 42, spaced apart a distance substantially equal to the width of the post between its sides 18 and 20. Formed in the scrolls 28 and 30 and extending inwardly from the side walls 44 and 46 thereof are chambers 48 and 50. As will be noted in FIGS. 2 and 3, the depth of the scroll members at said flat sections thereof is approximately equal to the depth of the post.

In the first form 10 of the invention, means for retaining the scroll in place on the post, in addition to the frictional contact of the scroll members about the post, comprises a backing plate 52 of an outline form the same as the face plate 22. The backing plate has inner and outer side walls 54 and 56. Compound holes 58 and 60 extend through the backing plate, and self-tapping screws 62 and 64 extend through the holes and into the chambers 48 and 50, thereby clamping the assembly in place on the post.

FIG. 5 shows a first modified clip-on form of the invention designated by reference numeral 10*a*. Here, the face plate 22*a* has scroll members which, at least at the flat sections 40*a* and 42*a* thereof have extensions 70*a*, 72*a*. The extensions are provided with inwardly directed lugs 74*a*, 76*a*, tapered to provide entry access. The lugs have abrupt interior walls 78*a*, 80*a*. When snapped about the post, the walls 78*a*, 80*a* contact the back side 16 of the post ot lock the same in place.

In FIG. 6 another modified scroll assembly 10*b* is shown. The assembly is larger in size, and requires dual connectors for stability. The connection means is best shown in FIG. 7 wherein it may be noted that the face plate 22*b* is enlarged, and that the extensions 70*b*, 72*b* are extended beyond the limit of the face plate on the scrolls 28*b* and 30*b*. Operation is otherwise as described with regard to the first modification.

I claim:

1. A decorative scroll for a fence having at least one vertical post with a front and a back side and of a depth from side to side, the scroll comprising:

a face plate having interior and exterior sides, and being of a width exceeding the width of the post and of a height from top to bottom adjacent the post;

a pair of laterally spaced scroll members secured on the interior side of the face plate, said scroll members having proximal surfaces which approach one another at opposing flat sections, said flat sections being of depths at least equal to the depth of the post and of heights approximately equal to the height of said face plate adjacent to the post, whereby said flat sections are adapted to frictionally grip the post therebetween;

the scroll members having inside walls; and means on the inside walls of the scroll members for engaging the back side of the post and for drawing the interior side of said face plate against the post.

2. The invention of claim 1, wherein:

said means comprise inward friction lugs.

3. The invention of claim 1, wherein:

said means comprise a backing plate; and fasteners extending through the backing plate and into the scroll members.

4. The invention of claim 1, wherein:

the fence post is metallic and the decorative scroll is plastic.

5. The invention of claim 1, wherein:

the post is substantially square in cross-section; and the scroll is equal in depth and in spacing to the corresponding dimensions of the post.

6. A decorative scroll for a metallic fence having vertical fence posts of substantially rectangular cross-section, the scroll comprising:

a face plate of a width exceeding the width of the fence post;

the face plate having an inner surface and an outer surface;

a pair of laterally spaced scroll members extending substantially perpendicularly inwardly from the inner surface of the face plate and having flat sections spaced to closely fit against the post, said scroll members having outside and inside walls;

the scroll members being of a depth substantially co-equal to the thickness of the post;

the scroll members being outwardly flared in decorative design form;

the scroll members having chambers formed therein opening on the inside walls thereof;

a backing plate abutting the inside walls of the scroll members, the backing plate having holes therein co-aligned with the chambers of the scroll members; and changeable fasteners extending through said holes and in said chambers to lock the backing plate against the post.

* * * * *